US006084212A

United States Patent [19]

Leigh

[11] Patent Number: 6,084,212

[45] Date of Patent: Jul. 4, 2000

[54] MULTI-LAYER CERAMIC HEATER ELEMENT AND METHOD OF MAKING SAME

[75] Inventor: Peter Leigh, Toronto, Canada

[73] Assignee: Le-Mark International Ltd, Kowloon, The Hong Kong Special Administrative Region of the People's Republic of China

[21] Appl. No.: 09/333,938

[22] Filed: Jun. 16, 1999

[51] Int. Cl.[7] ..... F23Q 7/22

[52] U.S. Cl. ..... 219/270; 123/145 A; 361/266

[58] Field of Search ..... 219/270, 544; 123/145 A, 145 R; 361/264, 265, 266

[56] References Cited

U.S. PATENT DOCUMENTS

| | | | |
|---|---|---|---|
| 4,418,661 | 12/1983 | Esper et al. | 123/145 A |
| 4,437,440 | 3/1984 | Suzuki et al. | 123/145 A |
| 4,540,479 | 9/1985 | Sakurai et al. | 219/544 |
| 4,742,209 | 5/1988 | Minegishi et al. . | |
| 4,816,643 | 3/1989 | Zulauf et al. | 219/270 |
| 4,901,196 | 2/1990 | Grzybowski | 361/266 |
| 5,084,606 | 1/1992 | Bailey et al. | 219/270 |
| 5,304,778 | 4/1994 | Dasgupta et al. . | |
| 5,519,187 | 5/1996 | Hinkle . | |
| 5,589,091 | 12/1996 | Muller | 219/270 |
| 5,993,722 | 11/1999 | Radmacher . | |

FOREIGN PATENT DOCUMENTS 0 648 978 A2 4/1995 European Pat. Off. .

*Primary Examiner*—Teresa Walberg
*Assistant Examiner*—Fadi H. Dahbour
*Attorney, Agent, or Firm*—Gowling, Strathy & Henderson

[57] ABSTRACT

A ceramic heater element and a glow plug incorporating the novel heater element. The heater element has a base portion and a heater portion. Conductive, insulative and resistive layers extend through both the base and heater portions. An outer conductive layer is applied to the outside of the base portion to provide a highly conductive return path. This tends to limit the heating of the resistive layer in the base portion and results in better and more reliable heat concentration in the heater portion. The heater element can be assembled to form a glow plug for a diesel engine.

23 Claims, 4 Drawing Sheets

MULTI-LAYER CERAMIC HEATER ELEMENT AND METHOD OF MAKING SAME

FIELD OF THE INVENTION

This invention relates to ceramic heater elements. In particular, this invention relates to ceramic heater elements, and methods of manufacture therefor, such as ceramic heaters used in high-temperature a glow plugs for diesel engines.

BACKGROUND OF THE INVENTION

It is well known to manufacture ceramic glow plugs having a multi-layered construction. Examples of such conventional glow plugs are described in U.S. Pat. Nos. 4,742,209, 5,304,778 and 5,519,187. In general, these glow plugs have a ceramic heater with a conductive core enclosed by insulative and resistive ceramic layers, respectively. The layers are separately cast and fitted together. The resulting green body is then sintered to form a ceramic heater. Such ceramic heaters suffer several drawbacks. Used in a glow plug, they experience cyclic heating and cooling, which results in high internal stresses at the interfacial junction between the ceramic layers, promoting eventual failure of the glow plugs. To reduce this failure rate, such ceramic heaters tend to be cycled at lower temperatures than would be optimal in a diesel engine.

The internal stresses of a layered glow plug are mainly the result of differences in the coefficients of thermal expansion between the differently composed layers. The different layers of the glow plug expand and contract at different rates. Further, residual stresses are the result of manufacture, particularly from uneven contraction in the cooling period which occurs below the plastic deformation state of the ceramic composition, and from non-uniform attachment between the layers.

A ceramic heater that has reduced internal stress is described in U.S. patent application Ser. No. 08/882,306, U.S. Pat. No. 5,993,722, filed Jun. 25, 1997. This application discloses a ceramic heater that is slip cast as a unitary body with a graduated composition in the interfacial boundary zones. While the ceramic heater described in this application has reduced internal stresses, it has been found to be difficult to manufacture to the stringent standards required of such heaters. In particular, the layer thicknesses are difficult to control precisely, and even minor discrepancies can lead to widely varying heat output in the final heater. Precise control of heating characteristics, and limiting heating losses in the base portion of the heater element, is important if the ceramic heaters are to be mass produced for vehicle and engine manufacturers.

It is, therefore, desirable to provide a ceramic heater element that overcomes the disadvantages of the prior art. In particular, it is desirable to provide a ceramic heater element that has low internal thermal stresses, and precisely controllable and reproducible heating characteristics that are focussed mainly to the heating tip of the element.

SUMMARY OF THE INVENTION

The disadvantages of the prior art may be overcome by providing a novel ceramic heater element, particularly for a glow plug, wherein the ceramic heater element has at least five layers, including an inner conductive core and an outer conductive layer that do not extend into the heater tip.

Generally, the present invention provides a ceramic heater element and a glow plug incorporating the novel heater element. The heater element has a base portion and a heater portion. Conductive, insulative and resistive layers extend through both the base and heater portions. An outer conductive layer is applied to the outside of the base portion to provide a highly conductive return path. This tends to limit the heating of the resistive layer in the base portion and results in better and more reliable heat concentration in the heater portion. The heater element can be assembled to form a glow plug for a diesel engine.

In a preferred embodiment of the present invention, the ceramic heater includes a base portion with a heater portion formed at one end. The heater portion has a lesser diameter than the base portion. The base portion and heater portion each having a conductive ceramic layer and a resistive ceramic layer, which are separated by an insulative ceramic layer except at a tip of the heater portion where they are electrically connected. The base portion further has an outer conductive ceramic layer in electrical contact with the resistive ceramic layer. An optional central conductive core can be included in this heater, which extends substantially the length of the base portion.

In a further embodiment of the present invention, there is provided a glow plug for a diesel engine, employing the above-described heater element. The glow plug has a metallic housing, including a barrel and a tapered sleeve. A ceramic heater element, having a base portion tapered to wedgingly fit within the sleeve, is mounted within the housing. The heater element has a heater portion formed at an end of the base portion. The heater portion has a lesser diameter than the base portion, and generally extends beyond the housing. The base portion and heater portion each having a conductive ceramic layer and a resistive ceramic layer, which are separated by an insulative ceramic layer except at a tip of the heater portion where they are electrically connected. The base portion further has an outer conductive ceramic layer in electrical contact with the resistive ceramic layer. An optional central conductive core can be included in this heater, which extends substantially the length of the base portion.

BRIEF DESCRIPTION OF THE DRAWINGS

An embodiment of the present invention will now be described, by way of example only, with reference to the attached Figures, in which.

DETAILED DESCRIPTION OF THE INVENTION

Figure 1:
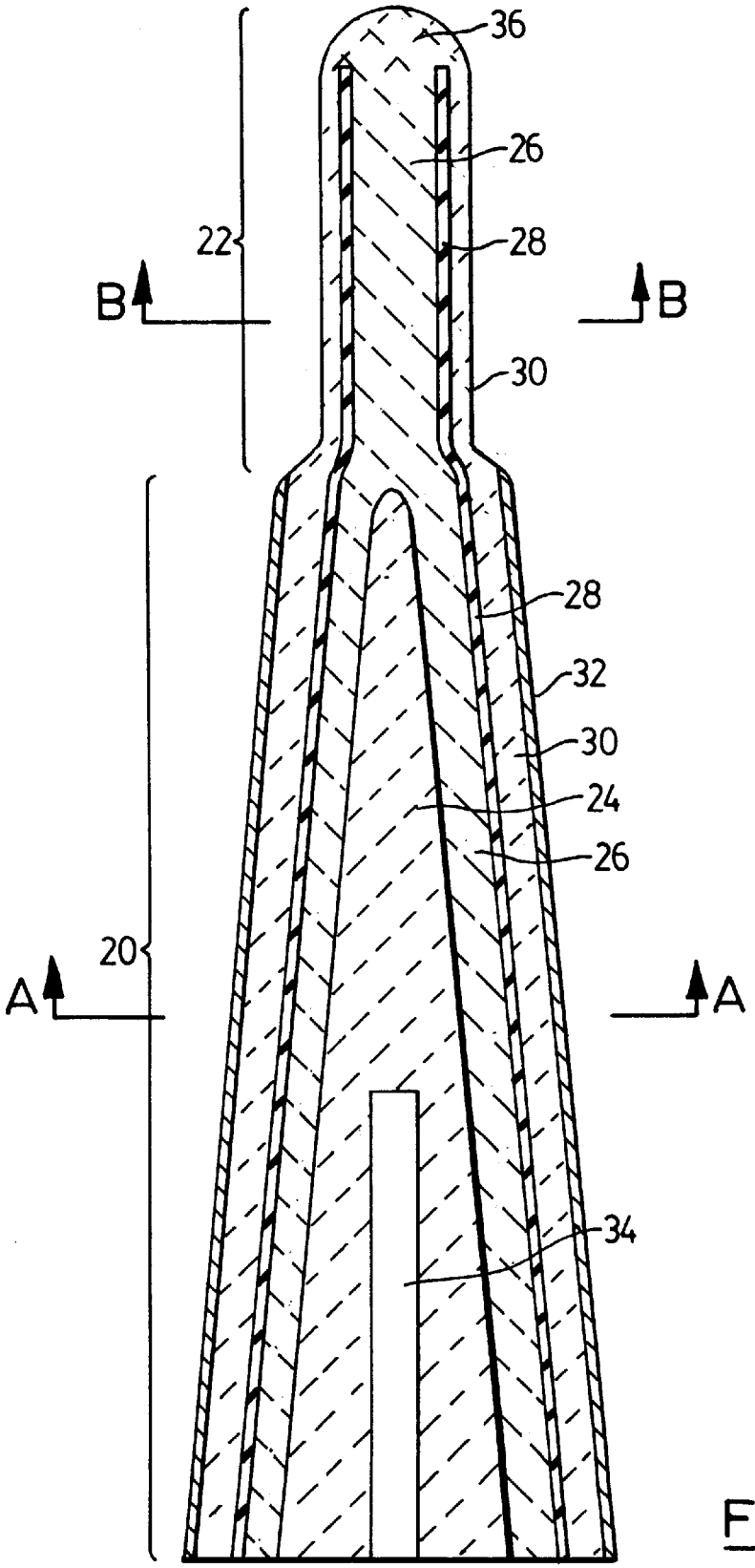
FIG. 1 is a schematic cross sectional view of a ceramic heater element according to an embodiment of the present invention, sectioned along its longitudinal axis.

The present invention will be now be described with reference to FIGS. 1 and 2. A schematic view of a ceramic heater element according to a first embodiment of the present invention is shown in cross-section along its longitudinal axis in FIG. 1, and in cross-section along line A—A in FIG. 2. The heater element is not shown to scale and is generally designated at reference numeral 10.

Element 10 consists of a base portion 20 and a heater portion 22. Base portion 20 and heater tip portion 22 form a generally cylindrical heater element that is thicker in diameter through base portion 20 and tapers to a thinner diameter heater portion 22. As is well known to those of skill in the art, base portion 20 is typically sized to be received in a metal housing, including appropriate electrical contacts, to form a glow plug for a diesel engine. As described in U.S. Pat. No. 5,880,432, entitled "Electric heating device with ceramic heater wedgingly received within a metallic body", the contents of which are incorporated herein by reference, one means of forming base portion 20 is to taper base portion 20 to permit it to be wedged into a suitable metal housing. It is fully within the contemplation of the present inventor that base portion 20 of heater element 10 can be so formed, but the present invention can be employed advantageously with any ceramic heater element, regardless of its particular shape and dimensions.

As is well known to those of skill in the art, heater portion 22 has a lesser diameter than base portion 20. This results in a higher resistance in heater portion 22, and, consequently, a higher heat output. Thus, heating of element 10 is ideally concentrated in heater portion 22.

Figure 2:
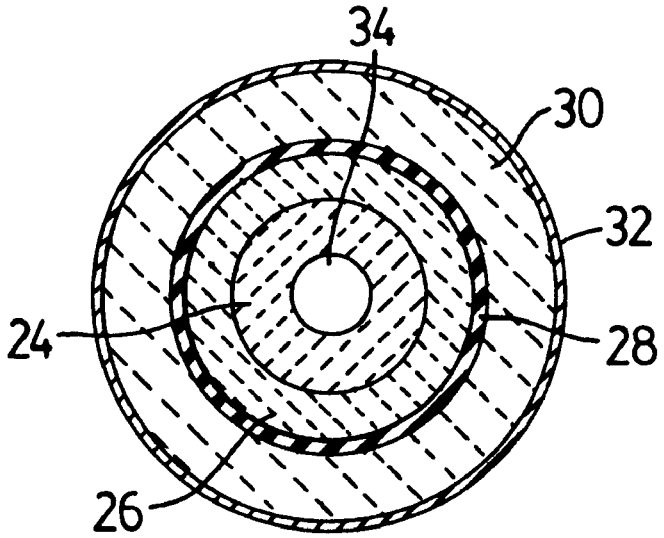
FIG. 2 is a schematic cross sectional view of the ceramic heater element according of FIG. 1, along the line A—A.

Referring to the preferred embodiment shown in FIGS. 1 and 2, base portion 20 is formed of five layers of ceramic material. As is well known, the composition of the layers differs, particularly in the amount of conductive ceramic component such as $MoSi_2$, such that the electrical conductivity of the different layers can be controlled. Beginning at the centre, base portion 20 consists of an inner electrically conductive core 24, an electrically conductive layer 26, an electrically insulative layer 28, an electrically resistive layer 30 and an outer electrically conductive layer or coating 32. Generally, base portion 20 also includes hole 34 that permits connection to an electrical lead (not shown) when element 10 is assembled as a glow plug. For the purposes of description, conductive layer 26 and resistive layer 30 are differentiated. However, as will be further described below, these two layers have similar characteristics, and any heating ascribed to resistive layer 30 can be equally well accomplished in conductive layer 26.

Figure 3:
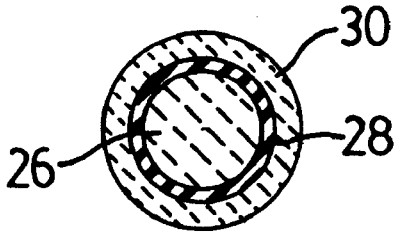
FIG. 3 is a schematic cross sectional view of the ceramic heater element according to FIG. 1, along the line B—B.

Referring to FIGS. 1 and 3, heater portion 22 is formed of three layers of ceramic material. Beginning again at the innermost layer, heater portion 22 consists of conductive layer 26, insulative layer 28 and resistive layer 30. The distal end of heater portion 22 is formed into a tip 36 that forms an electrical connection between conductive layer 26 and resistive layer 30.

Generally, the ceramic material forming the various layers is selected from the group comprising $Si_3N_4$, $Y_2O_3$, silicon carbide, aluminum nitride, alumina, silica and zirconia. These non-conductive ceramic materials are then doped with one or more conductive components selected from the group comprising $MoSi_2$, TiN, ZrN, TiCN and $TiB_2$. The percent concentration of the conductive component, in conjunction with the layer thickness, determines the resulting conductivity of the ceramic material. A sintering additive from about 10 to about 0 percent by volume can also be included. The sintering additive includes yttrium, magnesia, calcium, hafnia and others of the Lanthanide group of elements. The conductive and non-conductive components are supplied as finely ground particles. Optimally, the particles can range in size from about 0.2 to about 0.8 microns. The finely ground components are mixed and suspended in a solvent, such as water, to form a slurry. A suitable deflocculant, such as ammonium polyacrylate, known commercially as DARVAN C™ can also be added.

In a preferred embodiment, the non-conductive ceramic material is $Si_3N_4$ and the conductive component is $MoSi_2$. Inner core 24 can have 51–80 vol. % $MoSi_2$, conductive layer 26 can have 30–45 vol. % $MoSi_2$, insulative layer 28 can have 0–28 vol. % $MoSi_2$, resistive layer 30 can have 30–45 vol. % $MoSi_2$, and outer layer 32 can have 51–80 vol. % $MoSi_2$.

While this preferred embodiment has been described as having an inner conductive core 24, it is contemplated by the present inventor that heater element 10 can be formed of four layers, without a core. In this case, conductive layer 26 also occupy the volume of conductive core 24. The advantage that core 24 is presently believed to provide to heater element 10 is an improved conduction of electricity through base portion 20 to concentrate heat development in heater portion 22. It is also contemplated that heater element 10 can include a core that extends beyond the length of base portion 20. For example, for certain applications it may be desirable to have core 24 extend nearly to tip 36.

Ceramic heater element 10 is preferably manufactured by slip casting, such as is described in U.S. patent application Ser. No. 08/882,306, the contents of which are incorporated herein by reference. The method described therein is modified somewhat to incorporate the additional layers: inner core 24 and outer layer 32. An absorbent, tubular mold, open at both ends, is provided. The mold can be fabricated from plaster of Paris or any other suitable absorbent material. In a preferred embodiment the mold is provided with a smaller inner diameter step to produce element 10 having a relatively small diameter at heater portion 22.

Generally, successive layers of element 10 are added to the mold from the tip 36 end. The method commences with forming resistive layer 30. Next, insulative layer 28 is formed in the mold. It has been found, in a standard sized heater element, that insulative layer 28 needs to be at least 0.3 mm to provide an effective electrically insulative barrier between resistive layer 30 and conductive layer 26. And finally, conductive layer 26 is formed in a well known manner. Inner core 24 is then injected into the mold from the opposite end of the mold such that it extends substantially the length of base portion 20. Connecting hole 34 can be formed in inner core 24 at this time. To form an integral electrical connection between conductive layer 26 and resistive layer 30, tip 36 of the green body is reformed by, for example, applying low intensity vibrations from an ultrasonic wand to tip 36 before the green body is removed from the mold. The low intensity vibrations cause the particles at the tip to be blended into an electrically conductive tip joining the inner and outer volumes. Once the liquid phase has been substantially absorbed through the walls of the mold, the green body with a reformed tip is removed from the mold and allowed to air dry.

Prior to sintering the green body, it is dipped into a conductive ceramic slurry to form outer layer 32. This results in very thin coating of conductive material that covers base portion 20. As is well known, the green ceramic body is then sintered and polished to produce element 10.

Figure 4:
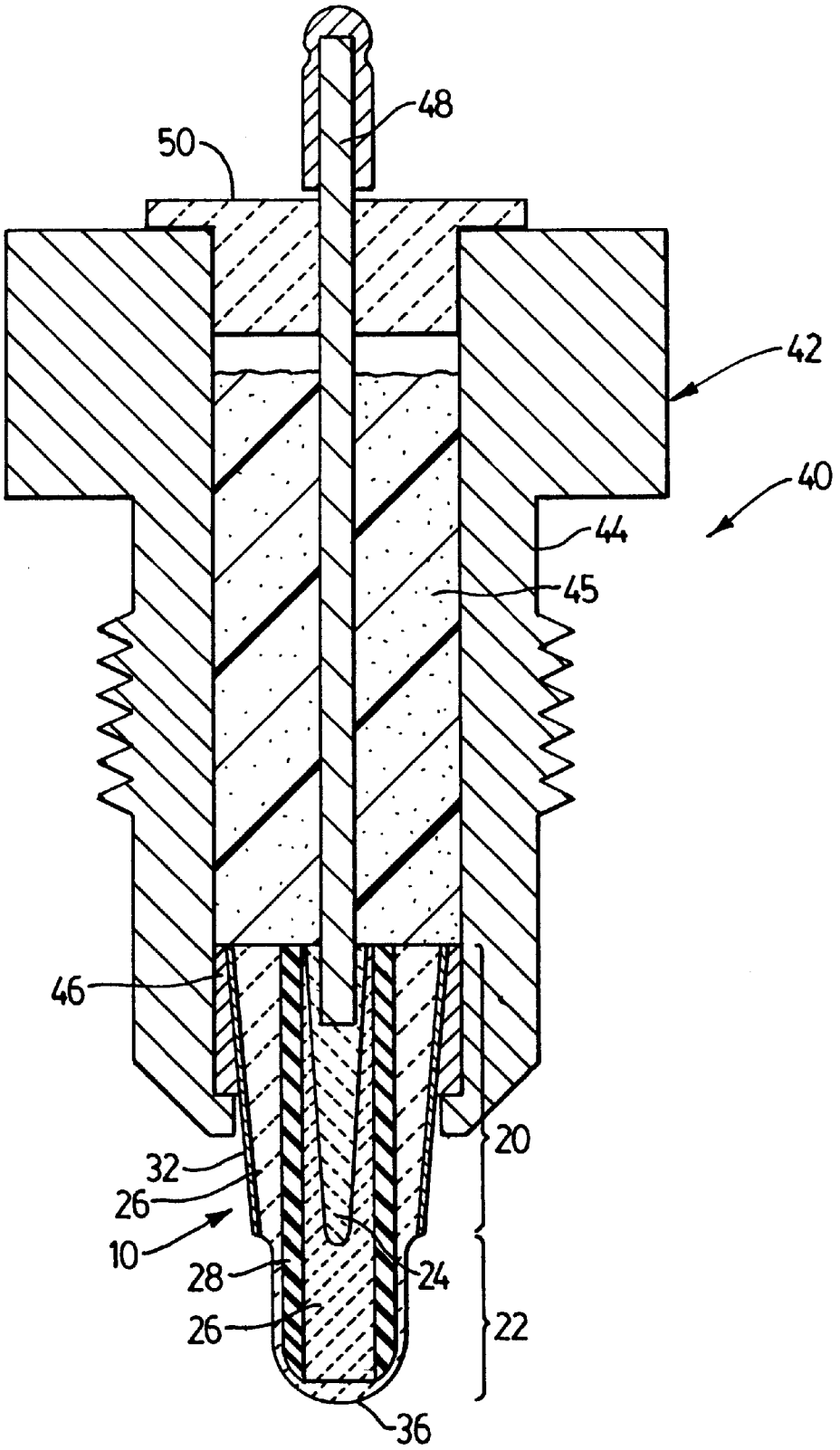
FIG. 4 is a cross section of a glow plug according to the present invention.

Referring to FIG. 4, element 10 can then be assembled to form a glow plug assembly 40, as described in the aforementioned U.S. Pat. No. 5,880,432. Element 10 is inserted into a metallic housing 42 consisting of a barrel 44 and a sleeve 46. Sleeve 46 is tapered to match the outer taper of base portion 20 such that element 10 is wedgingly held in place within housing 42. A conductive wire 48 is inserted into hole 34 of element 10, and element 10 and wire 48 are secured in place by filling barrel 44 with an epoxy, or other fixant suitable for operation in a corrosive, high temperature atmosphere. Barrel 44 is then sealed with connector cap 50.

As can be seen from FIG. 4, sleeve 46, and hence housing 42, is in electrical contact with outer layer 32, while wire 48 is in electrical contact with inner core 24. In operation, an electrical potential is applied across housing 42 and conductive wire 48. This causes an electrical current to flow from conductive wire 48 through conductive inner core 24 to conductive layer 26. The current then flows through resistive layer 30 at the exterior of heater portion 22, and returns along outer layer 32 to housing 42. As the current flows through resistive layer 30 in the region of heater portion 22, it heats heater portion 22 to a temperature sufficient for diesel fuel ignition. Experimental testing of element 10 has resulted in repeated cycling to heater temperatures in the range of 1500° C. without failure of the element. As will be understood by those of skill in the art, the high conductivity of outer layer 32 results in little current flow through the resistive layer 30 in the base portion 20, thus limiting the heating of the base portion, and improving the concentration of heat in the resistive layer 30 of heater portion 22.

Figure 5:
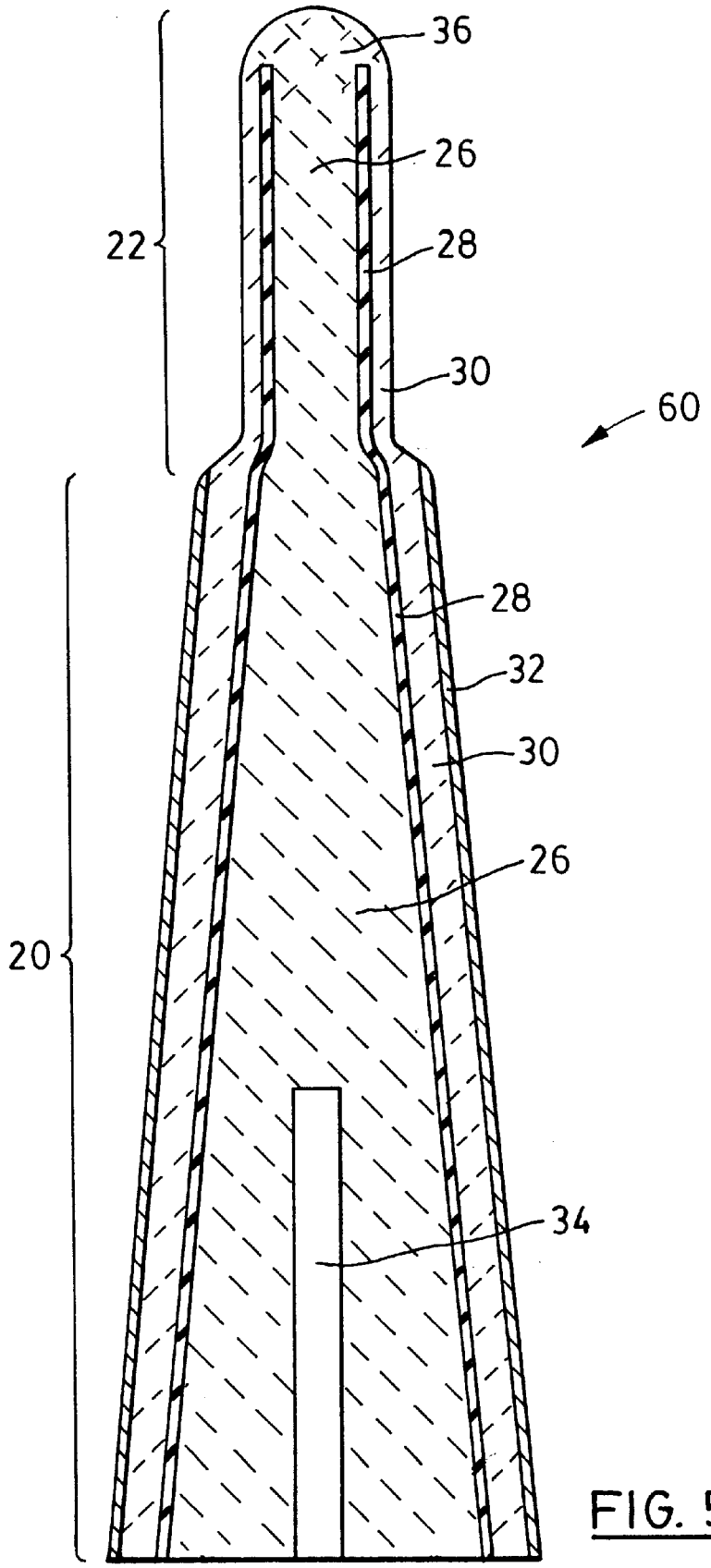
FIG. 5 is a cross section of a further embodiment of the heater element of the present invention.

Referring to FIG. 5, a further embodiment a ceramic heater element of the present invention is shown, and generally designated at reference numeral 60. This embodiment differs from the first embodiment in that it has no inner core. Generally, this four layer ceramic heater element 60 relies on the conductive inner core 24 to carry the electrical current to heater portion 22. The slightly less efficient resistivity of core 24 results in slightly lower operating temperatures, typically in the range of 1300° C., but has the benefit of lowering the production costs of the ceramic heater elements.

As will be appreciated by those of skill in the art, the ceramic heater element of the present invention has a number of advantages over the prior art. The conductive layer 26 and outer layer 32 result in a concentration of heat at heater portion 22, which enhances the stability and uniformity of the ceramic heater elements. Consequently, this results in the manufacture of fewer rejected pieces, thereby lowering production costs and increasing profit. The concentration of heat also results in a heater element that can be repeatedly cycled to approximately 1300–1500° C., which is a significant improvement over prior art ceramic heater elements which typically operate at 900–1100° C.

Although the disclosure describes and illustrates the preferred embodiments of the invention, it is understood that the invention is not limited to these particular embodiments. Many variations and modifications will now occur to those skilled in the art. For definition of the invention, reference is made to the appended claims.

I claim:

1. A ceramic heater element comprising:

a base portion; and a heater portion formed at an end of the base portion, the heater portion having a lesser diameter than the base portion;

the base portion and heater portion each having a conductive ceramic layer and a resistive ceramic layer, the conductive ceramic layer and resistive ceramic layer being separated by an insulative ceramic layer except at a tip of the heater portion wherein the conductive ceramic layer and resistive ceramic layer are electrically connected, and the base portion further having an outer conductive ceramic layer in electrical contact with the resistive ceramic layer.

2. An element according to claim 1, wherein each of the conductive, resistive, and insulative layers includes a non-electrically conductive ceramic component selected from the group consisting of $Si_3N_4$, silicon carbide, aluminum nitride, alumina, silica, and zirconia.

3. An element according to claim 2, wherein said conductive ceramic layer has a composition containing 30–45 vol. % electrically conductive ceramic component chosen from the group consisting of $MoSi_2$, $Y_2O_3$, TiN, ZrN, TiCN and $TiB_2$.

4. An element according to claim 1, wherein each of the conductive, resistive, and insulative layers includes a sintering aid component.

5. An element according to claim 2, wherein the resistive ceramic layer has a composition containing 30–45 vol. % electrically conductive ceramic component chosen from the group consisting of $MoSi_2$, TiN, ZrN, TiCN and $TiB_2$.

6. An element according to claim 2, wherein the insulative ceramic layer has a composition containing 0–28 vol. % electrically conductive ceramic component chosen from the group consisting of $MoSi_2$, $Y_2O_3$, TiN, ZrN, TiCN and $TiB_2$.

7. An element according to claim 2, wherein the outer conductive layer has a composition containing 51–80 vol. % electrically conductive ceramic component chosen from the group consisting of $MoSi_2$, TiN, ZrN, TiCN and $TiB_2$.

8. An element according to claim 1, further including a inner conductive ceramic core extending substantially the length of the base portion.

9. An element according to claim 8, wherein the inner conductive ceramic core has a composition containing 51–80 vol. % electrically conductive ceramic component chosen from the group consisting of $MoSi_2$, $Y_2O_3$, TiN, ZrN, TiCN and $TiB_2$.

10. An element according to claim 1, wherein the conductive layer, the resistive layer and the insulative layer are slip cast to form a green body.

11. An element according to claim 10, wherein the green body is dipped into conductive ceramic slurry to form the outer conductive layer.

12. A glow plug for a diesel engine, comprising:

a metallic housing, the housing including a barrel and a tapered sleeve;

a ceramic heater element mounted within the housing, the heater element having a base portion tapered to wedgingly fit within the sleeve, and a heater portion formed at an end of the base portion, the heater portion having a lesser diameter than the base portion, the base portion and heater portion each having a conductive ceramic layer and a resistive ceramic layer, the conductive ceramic layer and resistive ceramic layer being separated by an insulative ceramic layer except at a tip of the heater portion wherein the conductive ceramic layer and resistive ceramic layer are electrically connected, and the base portion further having an outer conductive ceramic layer in electrical contact with the resistive ceramic layer; and means to apply an electric potential across the conductive layer and the resistive layer.

13. A glow plug according to claim 12, wherein each of the conductive, resistive, and insulative layers includes a non-electrically conductive ceramic component selected from the group consisting of $Si_3N_4$, silicon carbide, aluminum nitride, alumina, silica, and zirconia.

14. A glow plug according to claim 13, wherein said conductive ceramic layer has a composition containing 30–45 vol. % electrically conductive ceramic component chosen from the group consisting of $MoSi_2$, $Y_2O_3$, TiN, ZrN, TiCN and $TiB_2$.

15. A glow plug according to claim 13, wherein each of the conductive, resistive, and insulative layers includes a sintering aid component.

16. A glow plug according to claim 13, wherein the resistive ceramic layer has a composition containing 30–45 vol. % electrically conductive ceramic component chosen from the group consisting of $MoSi_2$, $Y_2O_3$, TiN, ZrN, TiCN and $TiB_2$.

17. A glow plug according to claim 13, wherein the insulative ceramic layer has a composition containing 0–28 vol. % electrically conductive ceramic component chosen from the group consisting of $MoSi_2$, $Y_2O_3$, TiN, ZrN, TiCN and $TiB_2$.

18. A glow plug according to claim 13, wherein the outer conductive layer has a composition containing 51–80 vol. % electrically conductive ceramic component chosen from the group consisting of $MoSi_2$, $Y_2O_3$, TiN, ZrN, TiCN and $TiB_2$.

19. A glow plug according to claim 13, further including a inner conductive ceramic core extending substantially the length of the base portion.

20. A glow plug according to claim 19, wherein the inner conductive ceramic core has a composition containing 51–80 vol. % electrically conductive ceramic component chosen from the group consisting of $MoSi_2$, $Y_2O_3$, TiN, ZrN, TiCN and $TiB_2$.

21. A glow plug according to claim 12, wherein the conductive layer, the resistive layer and the insulative layer are slip cast to form a green body.

22. A glow plug according to claim 21, wherein the green body is dipped into conductive ceramic slurry to form the outer conductive layer.

23. A glow plug according to claim 19, wherein the means to apply an electrical potential includes a conductive wire fixed in a hole formed in the inner conductive core.

* * * * *